US007770973B2

(12) United States Patent
Gehner et al.

(10) Patent No.: US 7,770,973 B2
(45) Date of Patent: Aug. 10, 2010

(54) CHAIR

(75) Inventors: Carsten Gehner, Hannover (DE); Michael Englisch, Blender (DE)

(73) Assignee: Wilkhahn Wilkening + Hahne GmbH + Co. KG, Bad Munder (DE)

( * ) Notice: Subject to any disclaimer, the term of this patent is extended or adjusted under 35 U.S.C. 154(b) by 67 days.

(21) Appl. No.: 11/750,440

(22) Filed: May 18, 2007

(65) Prior Publication Data

US 2007/0273189 A1 Nov. 29, 2007

(30) Foreign Application Priority Data

May 22, 2006 (DE) ..... 10 2006 023 981

(51) Int. Cl.
*A47C 1/024* (2006.01)

(52) U.S. Cl. ..... 297/302.1; 297/300.2; 297/298; 297/284.11

(58) Field of Classification Search ..... 297/298, 297/296, 284.1, 302.2, 284.11, 303.1, 302.1, 297/300.2

See application file for complete search history.

(56) References Cited

U.S. PATENT DOCUMENTS

| | | | | |
|---|---|---|---|---|
| 4,641,885 | A * | 2/1987 | Brauning | 297/303.1 |
| 4,744,600 | A * | 5/1988 | Inoue | 297/300.5 |
| 4,830,430 | A * | 5/1989 | Schafer | 297/298 |
| 5,033,791 | A | 7/1991 | Locher | |
| 5,052,753 | A * | 10/1991 | Buchacz | 297/300.3 |
| 5,056,866 | A * | 10/1991 | Tobler | 297/303.3 |
| 5,150,948 | A * | 9/1992 | Volkle | 297/300.5 |
| 5,288,138 | A * | 2/1994 | Stulik et al. | 297/302.1 |
| 5,435,623 | A * | 7/1995 | Kapec et al. | 297/339 |
| 5,577,802 | A * | 11/1996 | Cowan et al. | 297/301.2 |
| 5,733,005 | A * | 3/1998 | Aufrere et al. | 297/340 |
| 6,601,918 | B2 * | 8/2003 | Mattsson | 297/284.11 |
| 7,036,882 | B2 * | 5/2006 | Elzenbeck | 297/300.1 |

FOREIGN PATENT DOCUMENTS

| | | | |
|---|---|---|---|
| CA | 2149898 | A1 * | 3/1995 |
| DE | 4331987 | | 3/1995 |
| DE | 19823632 | | 9/1999 |
| DE | 10318759 | | 7/2004 |
| DE | 60300064 | | 11/2005 |
| EP | 1256293 | | 11/2002 |

* cited by examiner

*Primary Examiner*—David Dunn
*Assistant Examiner*—Tania Abraham
(74) *Attorney, Agent, or Firm*—Stites & Harbison PLLC; Douglas E. Jackson

(57) ABSTRACT

The invention relates to a chair with a seat, a base support and a backrest, wherein the seat is mounted on the base support so as to be pivotable about a first pivoting axis and the backrest is mounted on the seat so as to be pivotable about a second pivoting axis. The two pivoting axes are arranged so as to be displaceable relative to one another in order to be able to change the seat depth.

11 Claims, 9 Drawing Sheets

2
21
20
19
1a
18
17
16
12
14
1b
11
15
3
22

CHAIR

The invention relates to a chair with a seat, a base support and a backrest, wherein the seat is mounted on the base support so as to be pivotable about a first pivoting axis and the backrest is mounted on the seat so as to be pivotable about a second pivoting axis.

A chair with a so-called "three-point mechanism" is known from DE-C-198 23 632, in which the front region of the seat and also the backrest are pivotably mounted on the base support, and an articulated connection is additionally provided between the rear region of the seat and the backrest. With this type of chair mechanism, it is possible for the user to move from an upright position, e.g. when writing, into a more relaxed, reclining position. The chair can be adapted to users of different weights by means of a spring member which is provided between the base support and the seat and the hardness of which is adjustable.

A chair with a two-point mechanism is known from DE-B-103 18 759, wherein the seat is mounted on the base support so as to be pivotable about a first pivoting axis and the backrest is mounted on the seat so as to be pivotable about a second pivoting axis. To produce a synchronous movement between the inclination of the seat and the inclination of the backrest, a control cable is provided between the base support, the seat and the backrest.

A chair with a two-point mechanism is also described in DE-A-43 31 987, in which the seat is mounted on the base support so as to be pivotable about a first axis and the backrest is mounted on the seat so as to be pivotable about a second axis, wherein the first axis extends at least approximately through the user's ankles and the second axis extends approximately through his hip joints.

The object of the invention is to improve the chair in such a way that an additional adaptation possibility is provided.

According to the invention, this object is achieved by the features of claim 1.

The chair substantially has a seat, a base support and a backrest, wherein the seat is mounted on the base support so as to be pivotable about a first pivoting axis and the backrest is mounted on the seat so as to be pivotable about a second pivoting axis. The two pivoting axes are arranged so as to be displaceable relative to one another, thereby providing the possibility of being able to adjust the seat depth in a simple manner. According to a preferred development of the invention, the chair has a two-point mechanism.

To adjust the seat depth, the seat advantageously has a first seat supporting part and a second seat supporting part, wherein the two seat supporting parts are arranged so as to be displaceable relative to one another and the first seat supporting part is connected to the base support and the second seat supporting part is connected to the back rest.

In a particular development, the second pivoting axis can be formed as a virtual pivoting axis arranged in the region of the rotation axis of the hip of a user sitting on the chair. For this purpose, the backrest can be guided relative to the seat, for example in an arc-shaped, especially circular arc-shaped guide. Whereas, with the conventional chair mechanisms, a relative movement always took place between the upper body and the backrest when the inclination of the backrest was changed, the relative movement is avoided in the case of this chair mechanism.

Consequently, the so-called "shirt-untucking effect" no longer occurs. Furthermore, the body of the seated person also remains optimally supported when the inclination of the backrest is changed and the spinal column is not loaded by transverse forces during displacement of the backrest. The pivoting axes can e.g. also be formed as a bending point and/or in the manner of a film hinge.

In a further development of the invention, a coupling mechanism is provided which, during a pivoting movement of the seat about the base support, executes a pivoting movement of the backrest relative to the seat with a specified synchronous relationship between the inclination of the seat and the inclination of the backrest. In this case, means can also be provided for changing the synchronous relationship.

In a further development, the pivoting movement of the seat and/or the backrest is sprung by at least one spring member.

In another embodiment, a first spring system is provided between the base support and the seat and a second spring system is provided between the seat and the backrest, wherein means are also provided for adjusting the spring behaviour of the two spring systems so that the pivotability of the seat in relation to the base support and the pivotability of the backrest in relation to the seat can be adapted to different requirements, especially to users of different weights.

Further developments and advantages of the invention will be further explained hereinbelow with the aid of the description and the drawings, wherein.

Figure 3B:
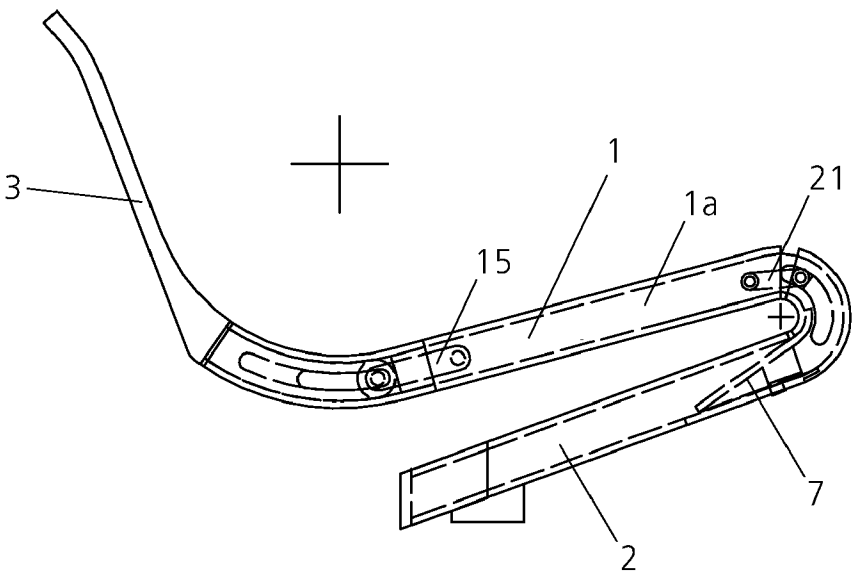
Figure 3A:
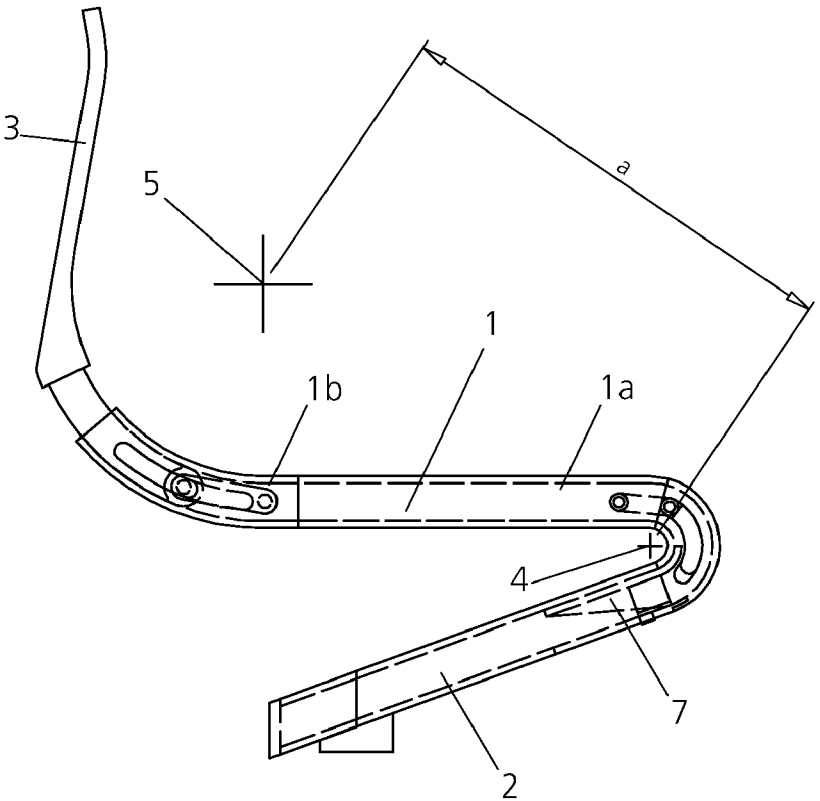
Figure 4B:
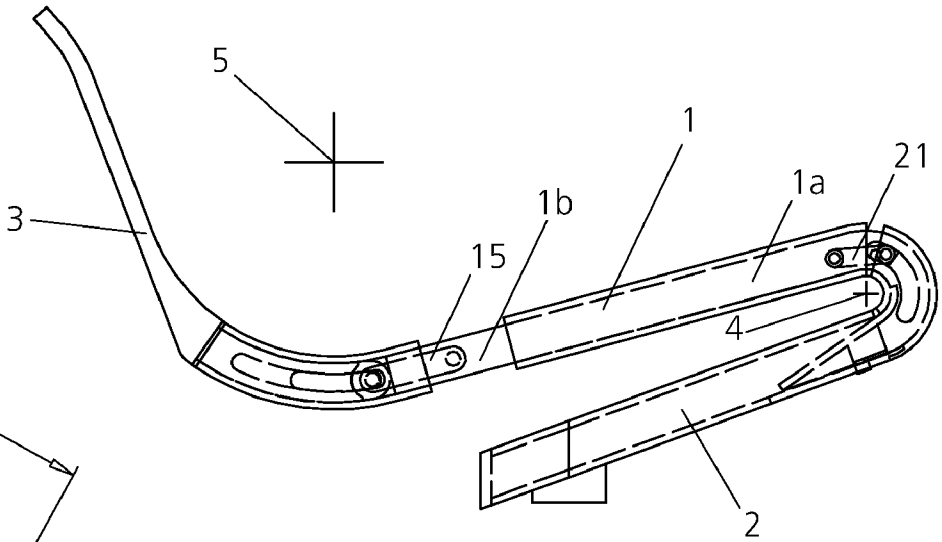
Figure 4A:
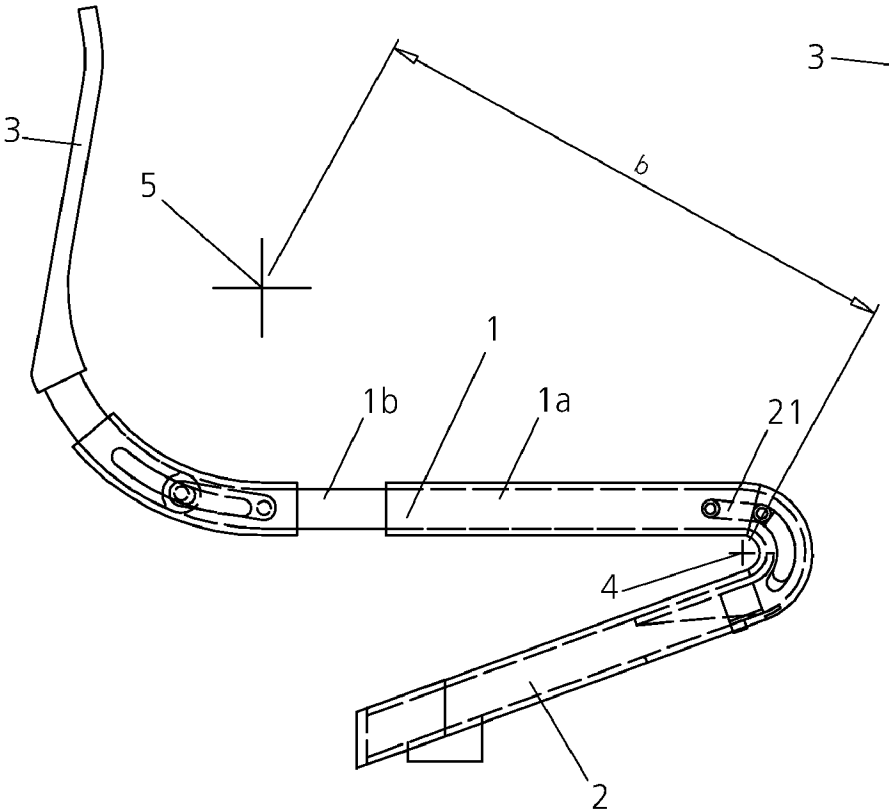
Figure 5:
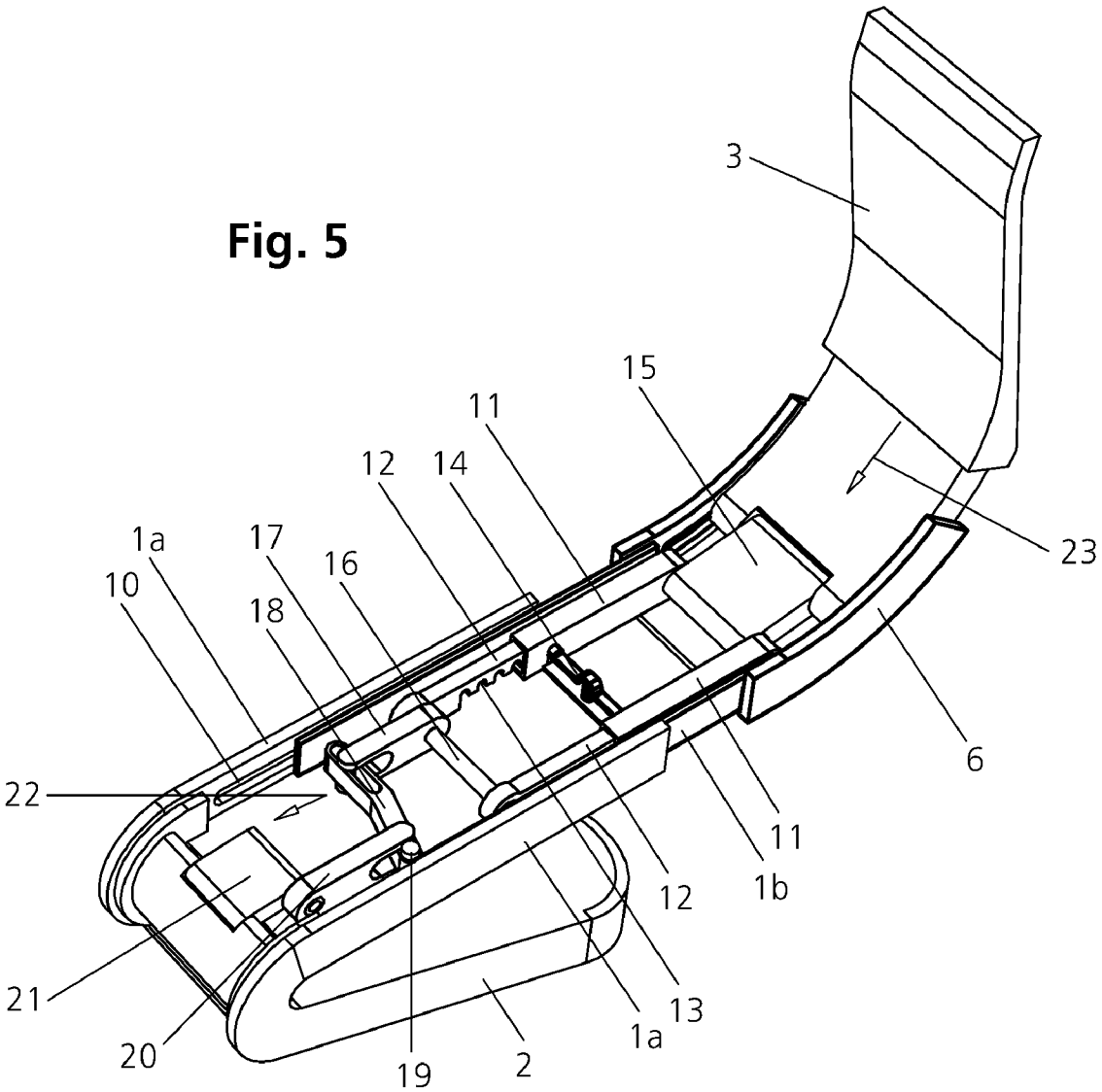
Figures 6A, 6B:
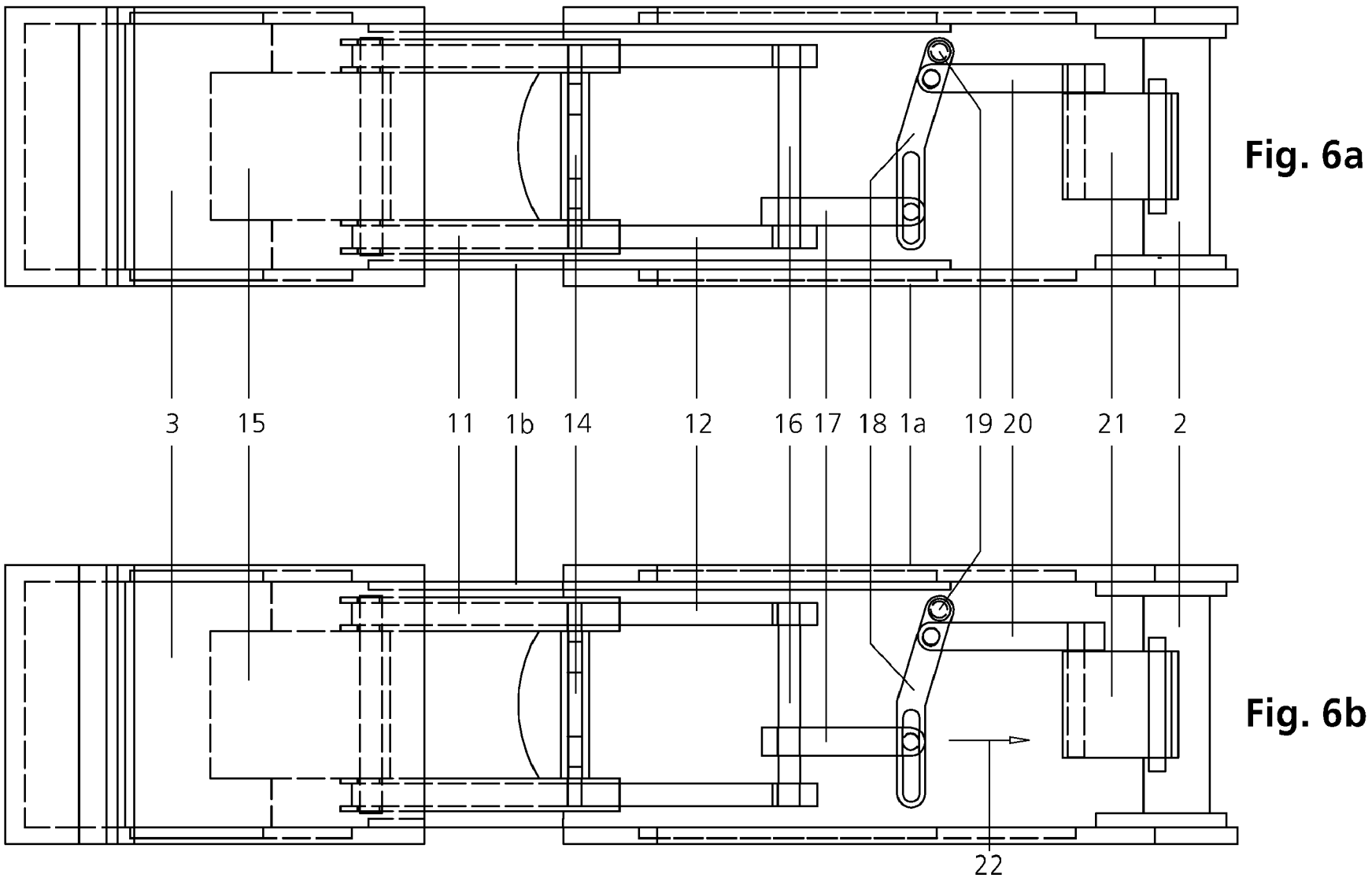
Figure 7B:
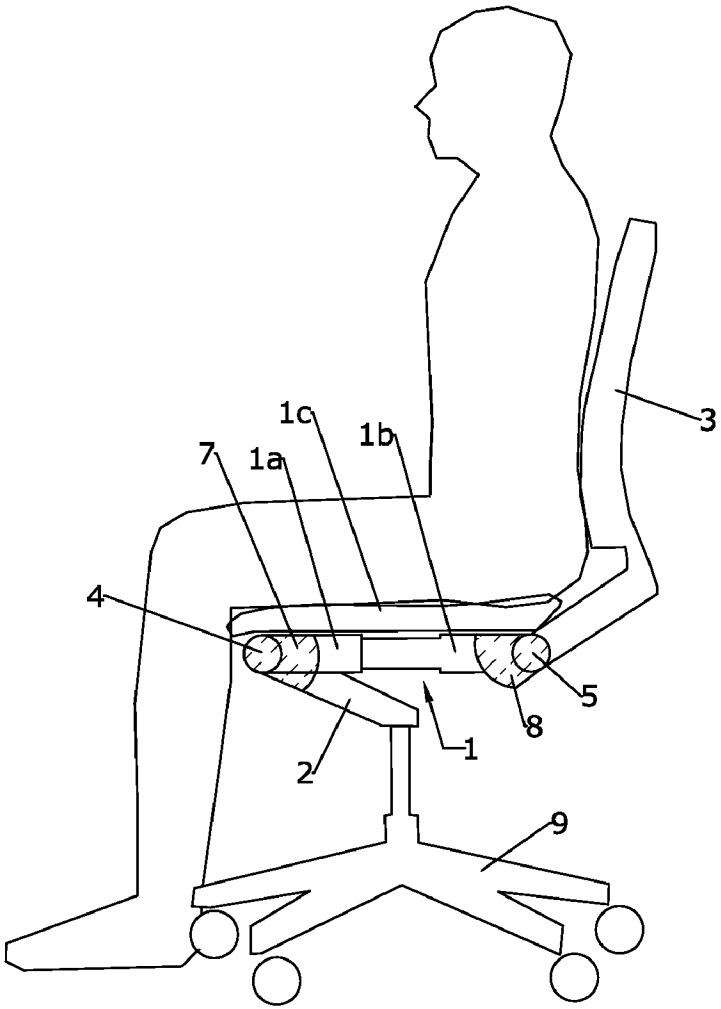
Figure 7A:
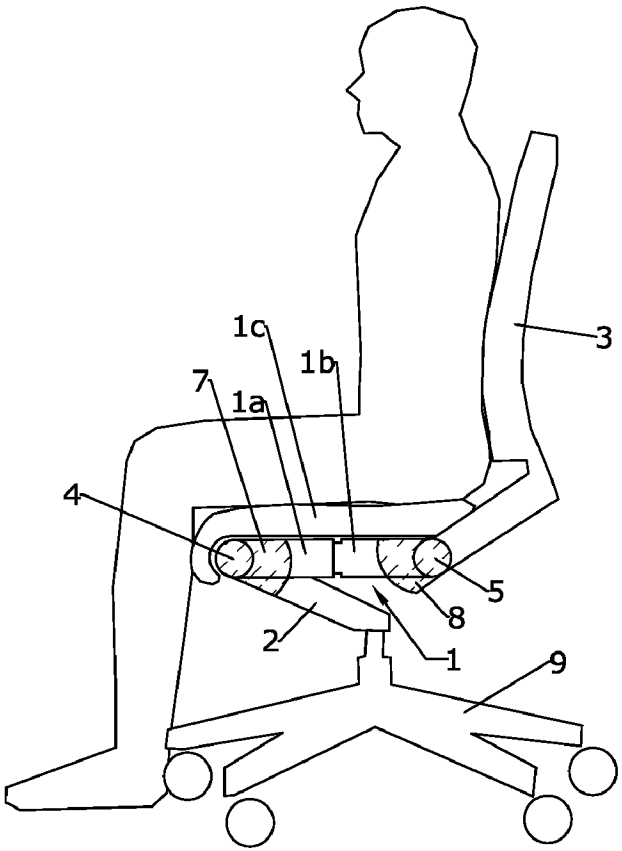
Figure 8A:
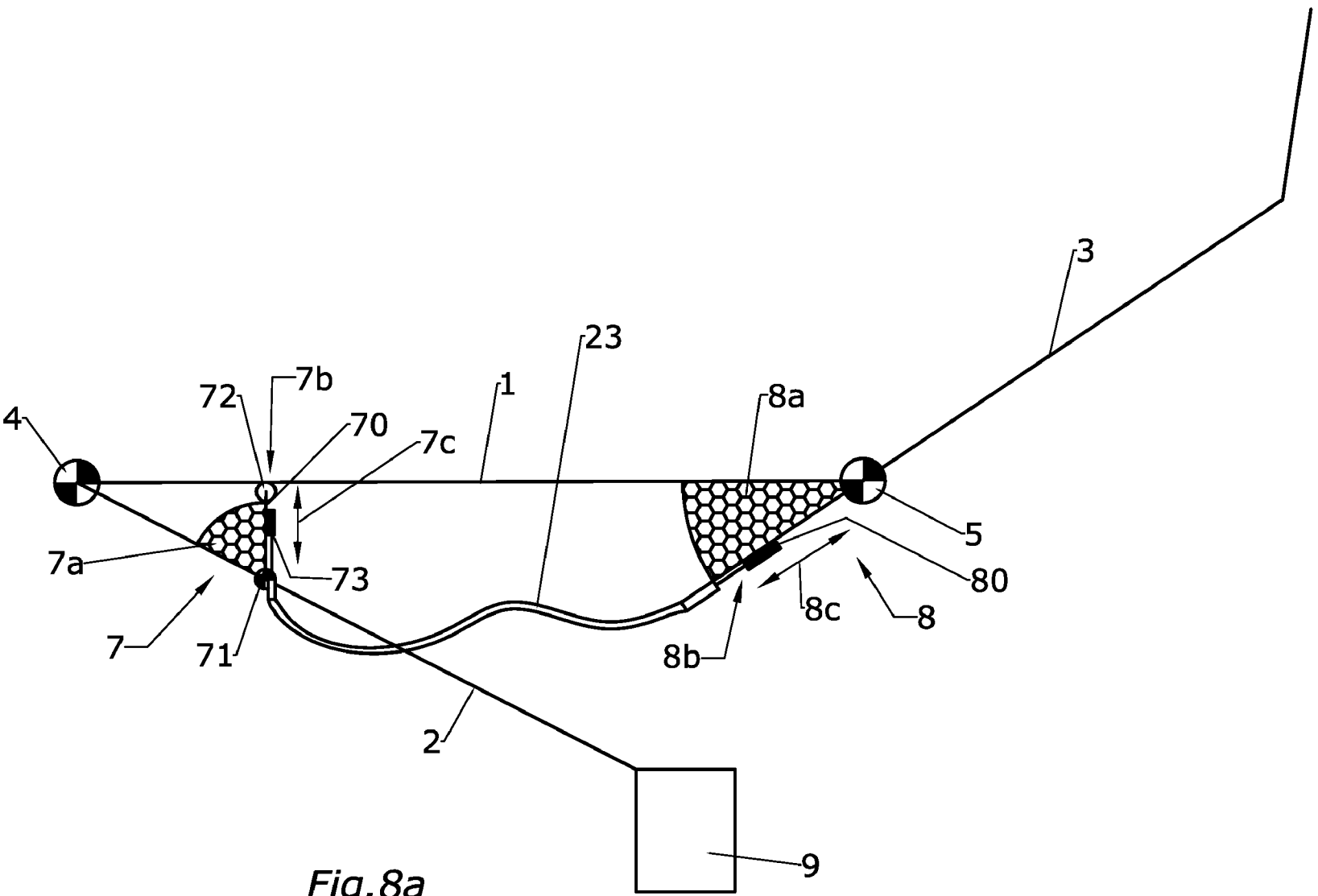
Figure 8B:
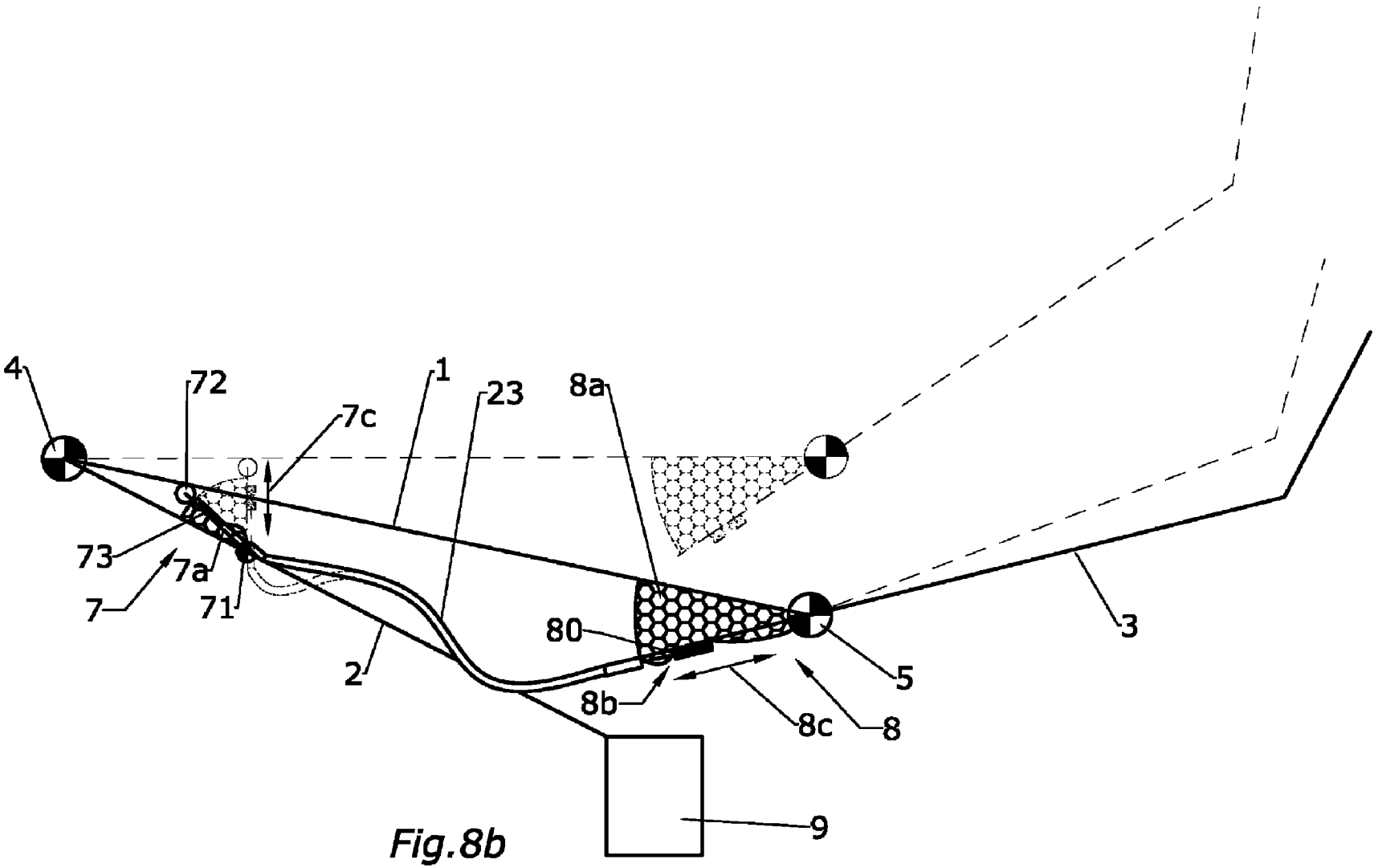

FIGS. 3*a*, 3*b* show side views of the chair in an upright and an inclined position;

FIGS. 4*a*, 4*b* show side views of the chair in an upright and an inclined position with an increased seat depth;

FIG. 5 shows a three-dimensional representation of the chair mechanism;

FIGS. 6*a*, 6*b* show plan views of the chair mechanism according to FIG. 5 with differently set synchronous relationships;

FIGS. 7*a*, 7*b* show side views of a chair according to a second embodiment with different seat depths; and FIGS. 8*a*, 8*b* show schematic representations of the chair according to FIG. 7*a* in an upright and an inclined position.

Figure 1:
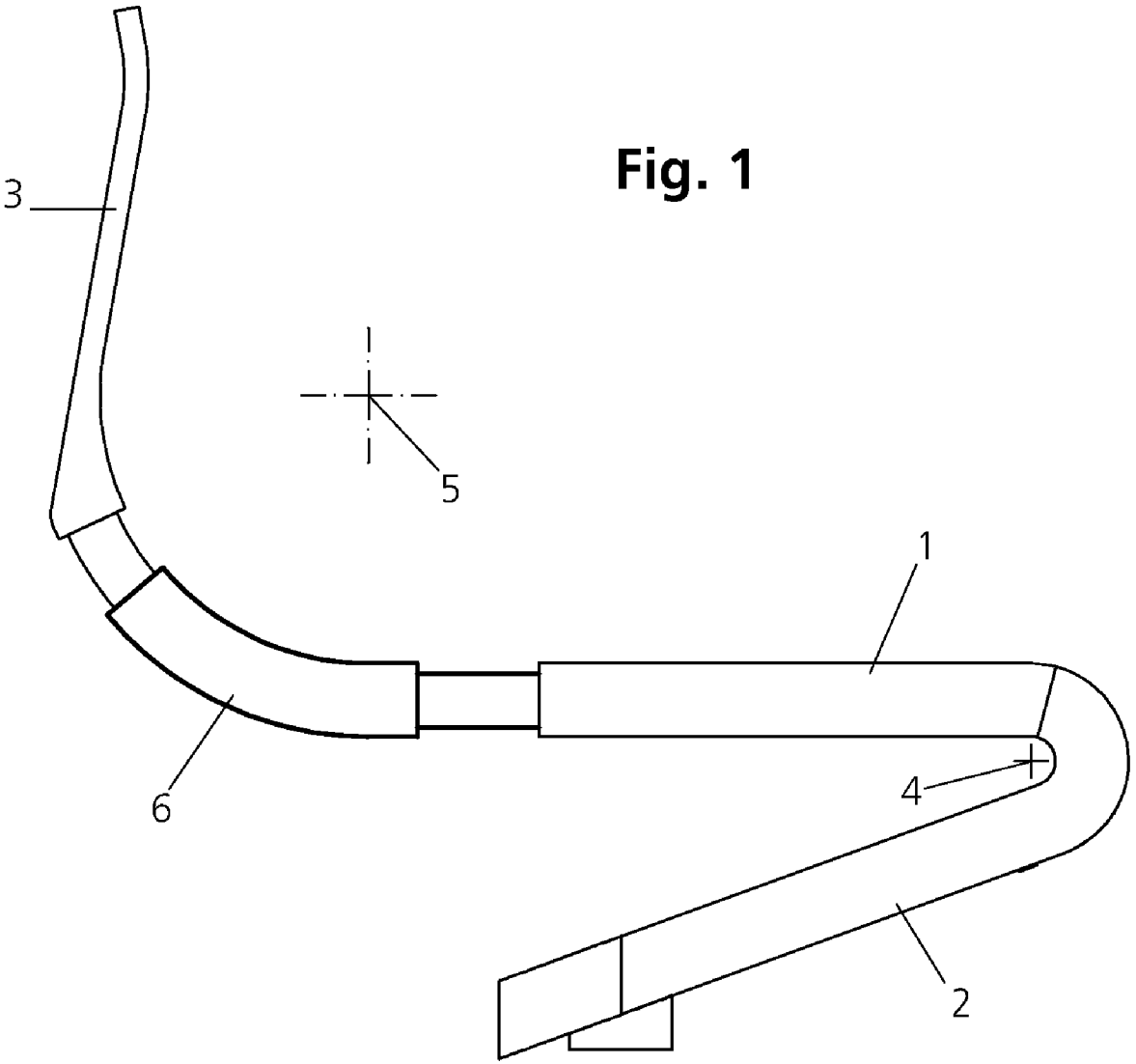
FIG. 1 shows a schematic side view of the chair.
Figure 2:
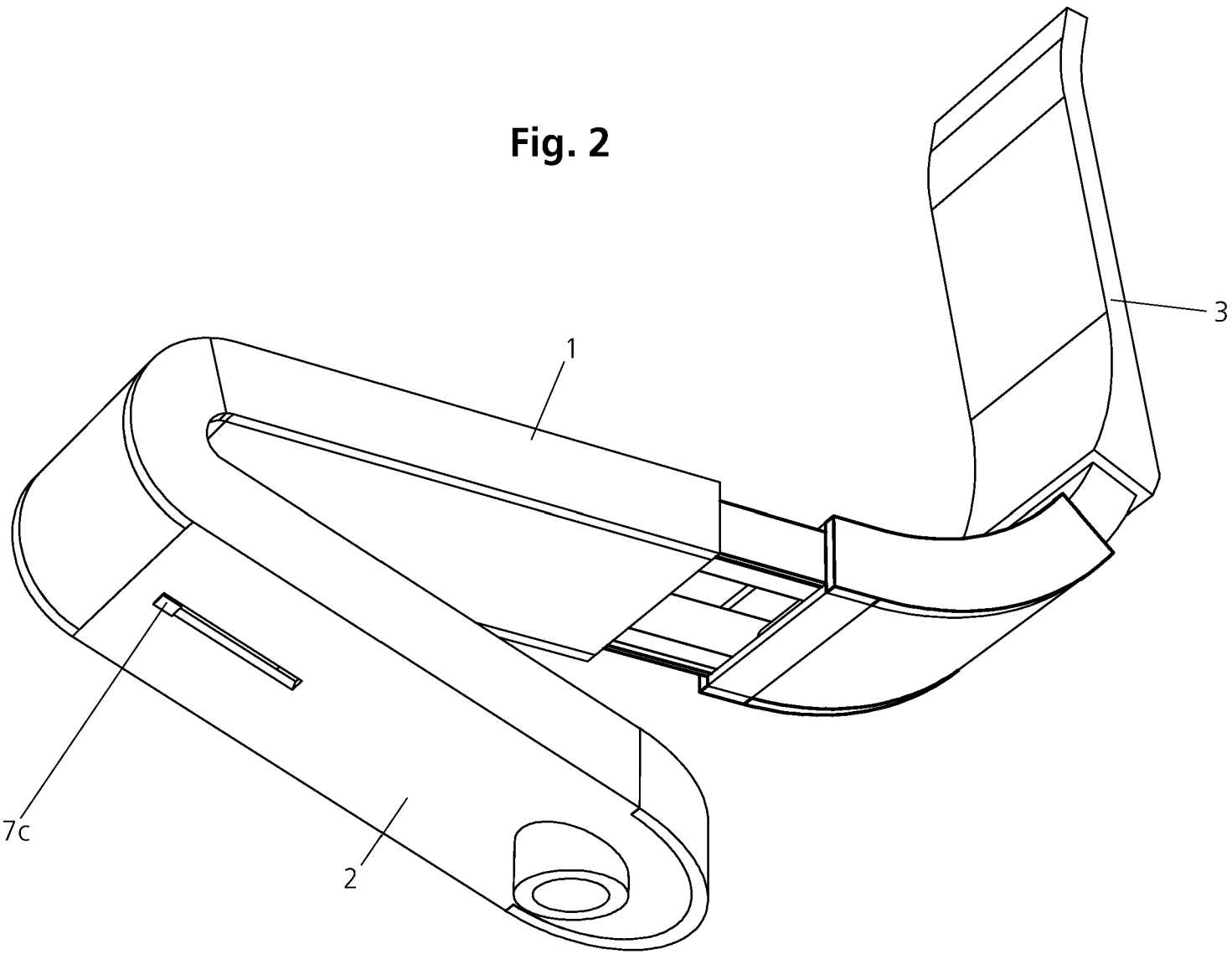
FIG. 2 shows a perspective view of the chair according to FIG. 1.

The chair schematically shown in FIGS. 1 and 2 substantially comprises a seat 1, a base support 2 and a backrest 3, wherein the seat is pivotably mounted on the base support and the backrest is pivotably mounted on the seat. The base support 2 is conventionally mounted on a foot or swivel frame (not shown in further detail). The seat and the backrest can in particular also comprise a seat support and a backrest support respectively.

The seat 1 is mounted on the base support 2 so as to be pivotable about a first pivoting axis 4. The pivotability is produced by a first spring system 7, for example in the form of a leaf spring, indicated in FIGS. 3*a* and 3*b*. The hardness of the spring system 7 can be set by adjustment means 7*c* on the underside of the base support (FIG. 2).

The backrest is mounted on the seat so as to be pivotable about a second pivoting axis 5 and is guided relative to the seat in an arc-shaped, especially circular arc-shaped guide 6. The second pivoting axis 5 is formed as a virtual rotation axis preferably arranged in the region of the rotation axis of the hip of a user sitting on the chair.

It can be seen from FIGS. 3*a* and 3*b* that the chair can be moved from an upright position according to FIG. 3*a* into an inclined position according to FIG. 3*b*. During this process, the seat 1 is pivoted about the first pivoting axis 4 and the backrest 3 is likewise pivoted about the second pivoting axis 5. By means of a coupling mechanism which will subsequently be further described with reference to FIGS. 5 and 6*a*, the seat and the backrest are inclined in a specified synchronous relationship.

A further special feature of the chair consists in that the two pivoting axes 4, 5 are arranged so as to be displaceable relative to one another. In the embodiment shown, this is achieved by the seat comprising a first seat supporting part 1*a* and a second seat supporting part 1*b*. As can be seen from FIGS. 3*a* and 4*a* in particular, the two seat supporting parts are arranged so as to be displaceable relative to one another, wherein the first seat supporting part 1*a* is connected to the base support 2 and the second seat supporting part 1*b* is connected to the backrest 3. In this case, the arc-shaped guide 6 is fixedly connected to the second seat supporting part 1*b*.

The displaceability of the two seat supporting parts provides the possibility of being able to adapt the seat depth to different requirements.

For example, it is possible in particular to adapt the seat depth to the length of the user's thigh.

The coupling mechanism, by means of which on the one hand the backrest and the seat can be inclined in a specified synchronous relationship and on the other hand the relative displaceability of the two seat supporting parts is rendered possible, will be further described hereinbelow with reference to FIGS. 5 and 6*a*.

The two seat supporting parts 1*a* and 1*b* each have two longitudinal sections forming a linear guide. The second seat supporting part 1*b* is longitudinally displaceably guided in grooves 10 in the first seat supporting part 1*a*. The arc-shaped guide 6 is fixedly connected to the second seat supporting part 1*b* at the rear end thereof. For its part, the backrest 3 is guided in the arc-shaped guide 6 and connected to the base support 2 by a coupling mechanism, which will be further described hereinafter.

This mechanism substantially comprises two box guides 11 in which sliding members 12 are telescopically guided. The sliding members 12 have, on their underside, recesses 13 which co-operate with a spring-loaded locking mechanism 14 in such a way that the position of the sliding members 12 relative to the box guide 11 can be fixed. The rear end of the box guide 11 is connected to the backrest 3 by a rear connecting member 15, wherein the rear connecting member is pivotably mounted both on the box guides 11 and on the backrest 3.

The two front ends of the sliding members 12 are connected to one another by a spindle 16. A force transmission member 17 is mounted on this spindle 16 and is held in a slot in a pivoted lever 18. The pivoted lever 18 is pivotable about a pivoting axis 19 provided on the first seat supporting part 1*a* and is actuated via a force transmission member 20 which is connected to the base support 2 by a front connecting member 21. For its part, the front connecting member 21 is pivotably mounted on the force transmission member 20 and the base support 2.

The seat depth is adjusted by releasing the locking mechanism 14 and then telescopically adjusting the sliding members 12 and the box guides 11. As the backrest 3 is connected to the box guides 11 by the rear connecting member 15, and the backrest 3 is guided in the guides 6 connected to the second seat supporting part 1*b*, this also produces displacement of the second seat supporting part 1*b* in the grooves 10 in the first seat supporting part 1*a*.

If a particular seat depth is fixed by the locking mechanism 14, the following sequence of movement of the coupling mechanism is produced when the seat 1 is inclined:

If, for example, the seat is moved from the upright position according to FIG. 4*a* into the inclined position according to FIG. 4*b*, the distance increases between the articulation point of the front connecting member 21 on the base 2 and the pivoting axis 19 fixedly connected to the first seat supporting part 1*a*. As a result, the lever 18 is rotated about the pivoting axis 19 in the direction of the arrow 22 via the force transmission member 20. The connecting member 15 is therefore also moved in the direction of the arrow 22 via the force transmission member 17, the spindle 16, the sliding members 12 and the box guides 11. As the backrest 3 is connected to the connecting member 15 in an articulated manner, the backrest 3 is thereby drawn into the guide 6 in the direction of the arrow 23.

If the seat is moved from the inclined position according to FIG. 4*b* into the upright position according to FIG. 4*a*, the sequence of movement is the exact reverse.

The slot in the pivoted lever 18 allows displacement of the force transmission member 17 on the spindle 16. The distance of the force transmission member 17 from the pivoting axis 19 defines the relationship between the inclination of the seat and the inclination of the backrest, with the result that the synchronous relationship can be changed by displacement of the force transmission member 17 on the spindle 16.

In FIG. 6*b*, the force transmission member 17 is closer to the pivoting axis 19 than in FIG. 6*a*, whereby the displacement of the force transmission member 17 in the direction of the arrow 22 is somewhat less great, resulting in correspondingly reduced inclination of the backrest.

A second embodiment will be described hereinbelow with reference to FIGS. 7*a* and 7*b* and FIGS. 8*a* and 8*b*.

The chair again substantially comprises a seat 1, a base support 2 and a backrest 3, wherein the seat is mounted on the base support so as to be pivotable about a first pivoting axis 4 and the backrest is mounted on the seat so as to be pivotable about a second pivoting axis 5. A first spring system 7 is provided between the base support 2 and the seat 1 and a second spring system 8 is provided between the seat 1 and the backrest 3.

The base support 2 is conventionally mounted on a foot or swivel frame 9.

In the second embodiment, the pivoting movement of the backrest 3 in relation to the seat 1 is not mechanically coupled to the pivoting movement of the seat 1 in relation to the base support 2. This chair therefore has a simple two-point mechanism.

The independence of the pivoting movements of the seat and the backrest therefore offers a relatively simple possibility of arranging the two pivoting axes 4, 5 so as to be displaceable relative to one another in order to permit adjustment of the seat depth.

In the embodiment shown, the seat comprises a first seat supporting part 1*a*, a seat supporting part 1*b* and a seat cushion 1*c*. The two seat supporting parts 1*a* and 1*b* are arranged so as to be displaceable relative to one another by a suitable mechanism, wherein the first seat supporting part 1*a* is connected to the base support 2 via the first pivoting axis 4 and the second seat supporting part 1*b* is connected to the backrest 3 via the second pivoting axis 5.

In this way, the seat depth can be specifically adapted to the respective user by displacement of the two seat supporting parts. Although it can be possible to fix the seat-depth setting, it is provided in a particular development of the invention that the seat depth is set automatically when the user sits down. In this case, it is possible for a spring member to be provided between the two seat supporting parts so that the seat adopts a contracted position in the unloaded state.

The spring system will be further described hereinbelow with reference to FIGS. 8*a* and 8*b*.

The upright position is shown in FIG. 8*a* and the tilted-back position is shown in FIG. 8*b*. The first spring system 7 provided between the base support 2 and the seat 1 has a first spring member 7*a* which co-operates with a first spring mechanism 7*b*. The first spring member 7*a* is formed e.g. by a foamed material wedge, for example made of Celasto. The first spring mechanism 7*b* has a pendulum rod 70, one end of which is mounted on the base support 2 about a pivoting axis 71 and the other end of which is in contact with the seat 1 via a rolling body 72. In the upright normal position of the chair as shown in FIG. 8*a*, the pendulum rod 70 is disposed almost perpendicularly to the seat 1. When the seat is inclined, the pendulum rod is deflected about the articulation point 71 as the rolling body 72 moves along the underside of the seat 1 in the direction of the first pivoting axis 4, whereby the first spring member 7*a* is compressed in accordance with the load.

In order to change the spring behaviour of the first spring system, the first spring mechanism 7*b* is also provided with a compression body 73 which is mounted on the pendulum rod and is adjustable by schematically shown means 7*c*.

For its part, the second spring system 8 comprises a second spring member 8*a* and a second spring mechanism 8*b* which has a compression body 80 which, in order to change the spring behaviour of the second spring system, can be displaced via schematically shown means 8*c*.

Furthermore, additional coupling means 23 can be provided which couple together the means 7*c* for adjusting the spring behaviour of the first spring system 7 and the means 8*c* for adjusting the spring behaviour of the second spring system 8 in such a way that the adjustment of the spring behaviour of the one spring system automatically effects adjustment of the spring behaviour of the other system. These coupling means can be formed e.g. by a Bowden cable and effect simultaneous displacement of the compression bodies 73 and 80.

By suitable co-ordination of the two spring systems 4, 5, the spring behaviour of the two spring systems can be adapted to the desired requirement in a single operation. In this way, it is ensured in particular that, even for users of different weights, substantially the same synchronous relationship between the inclination of the seat and the inclination of the backrest is rendered possible.

The invention claimed is:

1. A chair comprising:

a seat, a base support, a backrest, a base-seat pivoting mechanism for mounting the seat on the base support so as to be pivotable about a first pivoting axis, a backrest-seat pivoting mechanism for mounting the backrest on the seat so as to be pivotable about a second pivoting axis separated by a distance from the first pivoting axis, and a coupling system which couples the backrest to the seat, the coupling system including a locking mechanism for adjusting and then setting a distance between the first pivoting axis and the second pivoting axis so as to set a depth of the seat, and a coupling mechanism by which a pivoting movement of the seat relative to the base support about the first pivoting axis causes a pivoting movement of the backrest relative to the seat about the second pivoting axis with a specified synchronous relationship between the degree of pivoting of the seat and the inclination of the backrest.

2. A chair according to claim 1, wherein the base support, the seat and the backrest are connected to one another by a two-point mechanism.

3. A chair according to claim 1, wherein the first pivoting axis is provided in the region of the front end of the seat and the second pivoting axis is provided in the region of the rear end of the seat.

4. A chair according to claim 1, wherein said locking mechanism includes a first seat supporting part and a second seat supporting part and the two seat supporting parts are arranged so as to be displaceable relative to one another so as to vary the distance between the first pivoting axis and the second pivoting axis, and wherein the first seat supporting part is connected to the base support and the second seat supporting part is connected to the backrest.

5. A chair according to claim 1, wherein the second pivoting axis is arranged in the region of the rotation axis of the hip of a user sitting on the chair.

6. A chair according to claim 1, wherein the backrest is guided relative to the seat in an arc-shaped guide.

7. A chair according to claim 6, wherein said arc-shaped guide comprises a circular arc-shaped guide.

8. A chair according to claim 1, wherein the coupling mechanism includes a means for changing the synchronous relationship.

9. A chair according to claim 1, wherein the pivoting movement of the seat and/or the backrest is sprung by at least one spring member.

10. A chair according to claim 1, wherein a first spring system is provided between the base support and the seat and a second spring system is provided between the seat and the backrest, and wherein a means is also provided for adjusting the spring behaviour of the two spring systems so that the pivotability of the seat in relation to the base support and the pivotability of the backrest in relation to the seat can be adapted to different requirements.

11. A chair according to claim 1, wherein the first pivoting axis is located between the base support and the seat.

* * * * *